US010018006B2

(12) United States Patent
Motland

(10) Patent No.: US 10,018,006 B2
(45) Date of Patent: Jul. 10, 2018

(54) METHOD AND DEVICE FOR ACTIVATING AND DEACTIVATING A GS-TOOL

(71) Applicant: Qinterra Technologies AS, Stavanger (NO)

(72) Inventor: Arne Motland, Stavanger (NO)

(73) Assignee: Qinterra Technologies AS, Stavanger (NO)

( * ) Notice: Subject to any disclaimer, the term of this patent is extended or adjusted under 35 U.S.C. 154(b) by 48 days.

(21) Appl. No.: 15/114,213

(22) PCT Filed: Jan. 28, 2015

(86) PCT No.: PCT/NO2015/050019

§ 371 (c)(1),
(2) Date: Jul. 26, 2016

(87) PCT Pub. No.: WO2015/115909

PCT Pub. Date: Aug. 6, 2015

(65) Prior Publication Data

US 2017/0002619 A1 Jan. 5, 2017

(30) Foreign Application Priority Data

Jan. 28, 2014 (NO) ..... 20140100

(51) Int. Cl.
*E21B 31/00* (2006.01)
*E21B 31/12* (2006.01)
(Continued)

(52) U.S. Cl.
CPC ..... *E21B 31/20* (2013.01); *E21B 17/20* (2013.01); *E21B 23/02* (2013.01); *E21B 23/03* (2013.01)

(58) Field of Classification Search
CPC ..... E21B 31/00; E21B 31/12; E21B 31/20; E21B 23/02; E21B 23/03
See application file for complete search history.

(56) References Cited

U.S. PATENT DOCUMENTS 2,481,637 A * 9/1949 Yancey ..... B23D 21/00 166/55.1
5,580,114 A 12/1996 Palmer
(Continued)

FOREIGN PATENT DOCUMENTS

EP 2540956 A1 1/2013
EP 2599952 A1 6/2013
WO WO2013/079573 * 6/2013 ..... E21B 31/20

*Primary Examiner* — Cathleen R Hutchins
(74) *Attorney, Agent, or Firm* — Gable Gotwals

(57) ABSTRACT

This invention relates to a method for activating and deactivating a GS-tool (2) having grippers (22), tool housing (32), spindle (22), and main spring (50) arranged to pretension the gripper (44) towards a deactivated position as the GS-tool (2) is displaceable in a wellbore (10) in the ground. The method includes the steps of coupling the spindle (22) of the GS-tool (2) to an actuator mandrel (12) of an actuator (4); arranging an activating sleeve between the tool housing (32) and an actuator housing (14); and displacing the actuator mandrel (12) and thereby the spindle (22) relative to the tool housing (32) in a direction from the GS-tool (2) until the grippers (44) have reached activated positions by overcoming the force from the main spring (5). A GS-tool for implementing the method is also described.

10 Claims, 2 Drawing Sheets

I-I

(51) Int. Cl.

| | |
|---|---|
| ***E21B 31/20*** | (2006.01) |
| ***E21B 23/03*** | (2006.01) |
| ***E21B 23/02*** | (2006.01) |
| ***E21B 17/20*** | (2006.01) |

(56) References Cited

U.S. PATENT DOCUMENTS

| | | | |
|---|---|---|---|
| 5,775,433 | A | 7/1998 | Hammett et al. |
| 2005/0056427 | A1 | 3/2005 | Clemens et al. |

* cited by examiner

I–I

III–III

METHOD AND DEVICE FOR ACTIVATING AND DEACTIVATING A GS-TOOL

CROSS-REFERENCE TO RELATED APPLICATIONS

This United States application is the National Phase of PCT Application No. PCT/NO2015/050019 filed 28 Jan. 2015, which claims priority to Norwegian Patent Application No. 20140100 filed 28 Jan. 2014, each of which is incorporated herein by reference.

BACKGROUND OF THE INVENTION

The present invention relates to a method for activating and deactivating a GS-tool. More specifically it concerns a method for activating and deactivating a GS-tool which except for grippers, a tool-housing and a spindle comprises a main spring which is arranged to be able to pre-tension the grippers in a direction towards a deactivated position, the GS-tool being displaceable in a wellbore in the ground. The invention also relates to a device for activating and deactivating the GS-tool.

A so-called GS-tool is used to displace, set and pull objects in a wellbore. The wellbore may be unlined or lined, as well as provided with different appliances known to the skilled person. The term "GS" is well established in the art and is a well-known and precise term. The letters of the term "GS" do, as far as we know, not have any particular meaning.

The GS-tool fits in so-called GS-couplings. GS-couplings are often allocated to objects which are to be arranged in a wellbore. Somewhat simplified explained a GS-coupling comprises an inside encircling groove in a sleeve wherein the grippers which are on the GS-tool, optionally may grip.

GS-tools are commercially available from a number of providers as for instance Western Pressure Control Ltd, Canada.

Known GS-tools correspond, with the exception of the inventive features, with the explanation of implementation and mode of operation as described in the specific part of the document. A group of known GS-tools are pre-tensioned on the surface such that the grippers are in engagement with an object which is to be placed in the wellbore, after which the GS-tool is locked by a shear bolt. When the object is placed at a desired location in the wellbore, blows are directed towards the GS-tool in order to break the shear bolt. Alternatively, a directional force may be used in the wellbore to break the shear bolt such that the grippers are displaced to their passive positions. It is known that blows and relatively large axial forces which have to be applied to the GS-tool in order to provide a releasing may inflict damage on the object.

The patent publication U.S. Pat. No. 5,775,433 shows a pulling tool for use together with coiled tubing. The pulling tool comprises a first spring and a second spring. The first spring exerts an axial force on a first end portion of the grippers in the nose portion of the pulling tool such that the grippers are held in an active, gripping position. The axial force of the first spring is overcome when the tool is lead into a fish neck in a well tool such that the grippers are displaced firstly axially towards the coiled tubing and thereafter axially and radially inwards to a passive, non-gripping position in order to be able to pass an inwardly protruding flange in the fish neck. When the second free end portions of the grippers have passed the inwardly protruding flange, the grippers are displaced back to their active, gripping position by the first spring, and the pulling tool is in a gripping engagement with the fish neck. The pulling tool is released by increasing the pressure in a fluid in the coiled tubing. An outer piston sleeve is forced by the increased fluid pressure in axial direction towards the coiled tubing and compresses the second spring. The piston sleeve is provided with an outer housing which encloses the first end portion of the gripper. The axial movement of the housing urges the grippers in axial direction towards the coiled tubing and the grippers are thereby led to their passive, non-gripping position. The tool thus may be released from the fish neck.

Patent publication EP 2599952 shows a pulling tool for use together with coiled tubing, a drill string and a wireline tool. The pulling tool comprises a first spring and a second spring. The first spring exerts an axial force on a first end portion of the grippers in the nose portion of the pulling tool, such that the grippers are held in an active, gripping position. The axial force of the first spring is overcome when the tool is urged into a fish neck in a well tool such that the grippers are displaced first axially and then both axially and radially inwardly to a passive, non-gripping position in order to be able to pass an inwardly protruding flange in the fish neck. When the second free end portions of the grippers have passed the inwardly protruding flange, the grippers are displaced back to their active, gripping positions by the first spring, and the pulling tool is in a gripping engagement with the fish neck. Further, the grippers are held in their active positions by a piston sleeve which encloses the first end portion of the grippers. The piston sleeve is led towards the free end of the tool by means of a hydraulic fluid. In order for the grippers to initially be in their active positions, the piston sleeve is activated by the hydraulic fluid. This overcomes the axial force from the second and spring as the second spring seeks to displace the piston sleeve to its passive position. The second spring constitutes a safety device for releasing the tool from the fish neck if the object which is to be pulled, is stuck. This is done by reducing the hydraulic pressure and urging the tool somewhat into the object such that the grippers are led to their passive positions.

The patent publication U.S. 2005/0056427 shows a pulling tool which is fastened to an actuator mandrel. The actuator mandrel is movable in the longitudinal direction and is driven by a power unit. The pulling tool comprises a first spring and a second spring. The first spring exerts an axial force on a first end portion of grippers in the nose portion of the pulling tool such that the grippers are held in an active, gripping position. The axial force of the first spring is overcome when the tool is led into a fish neck in a well tool such that the grippers are displaced first axially and then both axially and radially inwards to a passive, non-gripping position in order to be able to pass an inwardly protruding flange in the fish neck. When the second free end portions of the grippers have passed the inwardly protruding flange, the grippers are displaced back to their active, gripping position by the first spring, and the gripping tool is in a gripping engagement with the fish neck.

The invention has for its object to remedy or reduce at least one of the drawbacks of the prior art.

The object is achieved in accordance with the invention by the features given in the description below and in the claims that follow.

The invention is defined by the independent patent claims. The dependent claims define advantageous embodiments of the invention.

In accordance with a first aspect of the invention, a method is provided for activating and deactivating a GS-tool wherein the GS-tool in addition to grippers, a tool-housing and a spindle comprises a main spring which is arranged to be able to pre-tension the grippers to deactivated position, as the GS-tool is displaceable in a wellbore in the ground, and wherein the method comprises:

- to couple the spindle of the GS-tool to the actuator mandrel of the actuator;
- to arrange an activating sleeve between the tool housing and an actuator housing; and
- to displace an actuator mandrel and thereby the spindle relative to the tool housing in a direction from the GS-tool until the grippers have reached their activated positions by overcoming the force from the main spring.

By coupling the GS-tool to an actuator, displacement of the grippers between their active and passive positions may be carried out without blows or use of the relatively large forces which have to be applied to a shear bolt in order for it to break or be cut off.

The actuator may be of any suitable kind such as hydraulic, pneumatic, mechanic or electric. The applicant's own actuator which is marketed under the name "PT Stroker", has proved to be suitable for the purpose.

The method may comprise to maintain the grippers in an activated or deactivated position during displacement of the GS-tool into or out of the wellbore.

The method may comprise to bring an object into or out of the wellbore, as the object, while it is in the wellbore, is released from or coupled to the GS-tool by displacing the actuator mandrel without blows, relative to the actuator housing. Change in the position of the grippers thus is carried out by activating the actuator whereby the actuator mandrel is displaced relative to the actuator housing.

In a second aspect of the invention, a GS-tool is provided which is displaceable in a wellbore in a ground, wherein the GS-tool comprises grippers, a tool housing and a spindle, and further comprises a main spring arranged to be able to pre-tension the grippers in a direction of a deactivated position, and wherein the spindle of the GS-tool is coupled to an actuator mandrel of an actuator, and wherein an activating sleeve is arranged between the tool housing and an actuator housing, and wherein the main spring is tensioned and the grippers are in their activated positions when the spindle is displaced towards the actuator.

The activating sleeve may preferably be fastened to the actuator housing. It may also be loose, attached to the tool housing or directly or indirectly attached to both the actuator housing and the tool housing.

The activating sleeve may on the outside be provided with a plurality of guiding ribs. The guiding ribs are arranged such that they encircle the activating sleeve. The guiding ribs contribute to keeping the GS-tool centred in the wellbore.

The grippers may be displaceable on an activating cone between their activated and deactivated positions, as the activating cone is coupled to or constitute part of the spindle.

An assembly of the GS-tool and the actuator may, depending on the actual conditions, be coupled to an automotive propulsion device, a string, for instance a pipe string, coiled tubing or a cable.

A method and device in accordance with the invention provide a considerably more controllable activating- and deactivating operation than what is possible for known GS-tools, which first of all reduces the risk of damaging the object during connection and disconnection.

In the following is described an example of a preferred method and embodiment which is visualized in the accompanying drawings, wherein.

Figure 1:
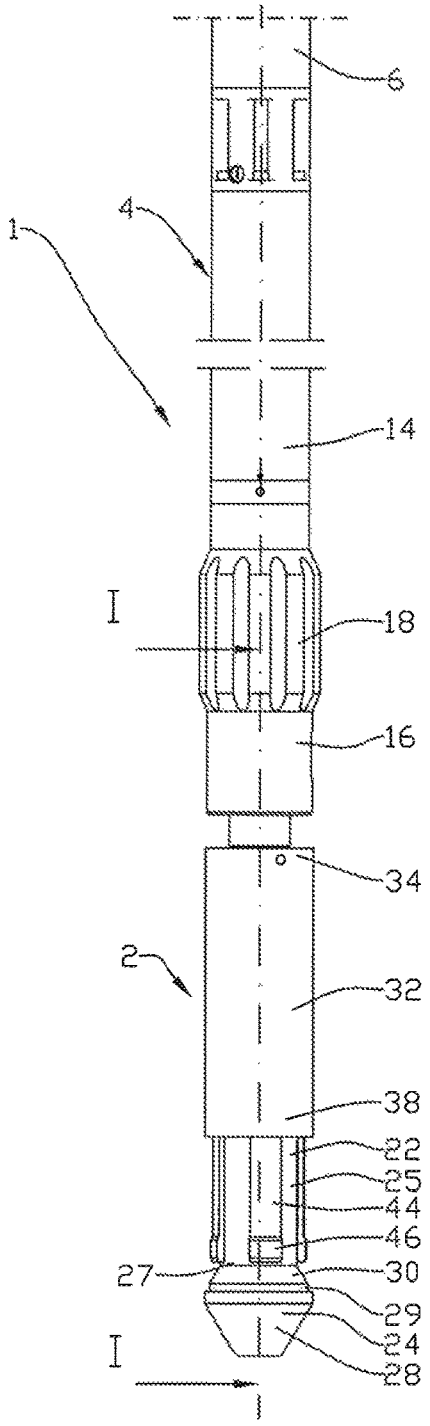
FIG. 1 shows an assembly in accordance with the invention of a deactivated GS-tool and an actuator.
Figure 3:
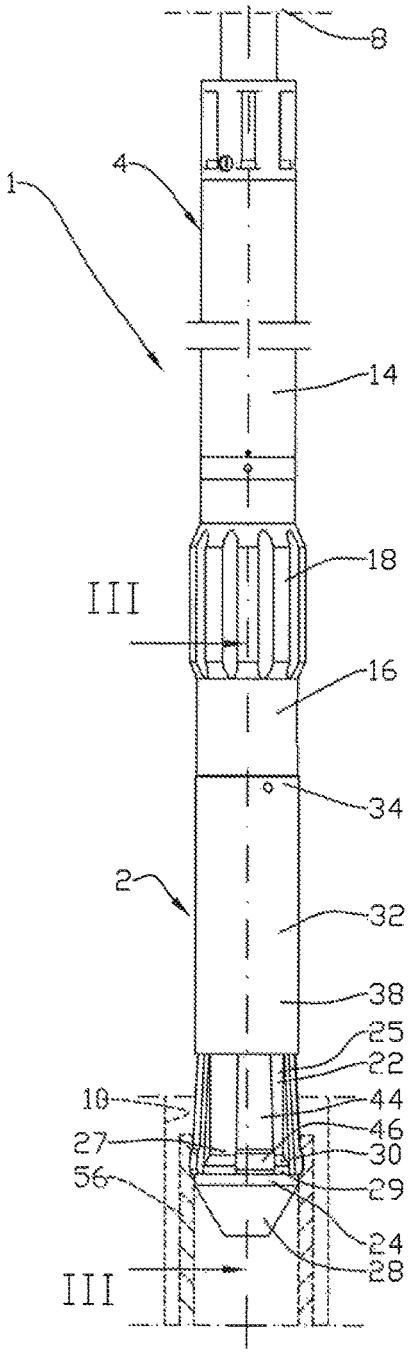
FIG. 3 shows the same as in FIG. 1, but where the GS-tool is activated.

In the drawings the reference numeral 1 denotes an assembly of a GS-tool 2 and an actuator 4. The actuator 4 is in FIG. 1 coupled to an automotive propulsion device 6, whereas it in FIG. 3 is coupled to a connection 8 in the form of a string, coiled tubing or a cable which are all used to displace the assembly 1 in a wellbore 10, see FIG. 3.

The actuator 4 may be a so-called PT stroker which is marketed by the applicant. The actuator 4 comprises an actuator mandrel 12 which is axially displaceable relative to the actuator housing 14 between an extended and a withdrawn position. The actuator 4 is generally known by the skilled person and will not be described further herein.

An activating sleeve 16 which is connected to the actuator housing 14 is provided with a through-hole 20 for the actuator mandrel 12. The activating sleeve 16 is on the outside provided with a plurality of guiding ribs 18. The guiding ribs 18 are arranged such that they encircle the activating sleeve 16. The guiding ribs 18 contribute to keeping the GS-tool 2 centred in the wellbore 10.

The GS-tool 2 comprises a spindle 22 in a proximal portion 23 which has a first smallest diameter and which in a distal portion 25 has a second diameter which is larger than the first diameter. A spindle shoulder 26 is formed between the proximal portion 23 and the distal portion 25. The spindle 22 is at its leading end portion 27 provided with a nose cone 24. The nose cone 24 is shaped with a distal, outer cone 28 which contributes to steering the assembly 1 during displacement in the wellbore 10. The nose cone 24 is provided with an activating cone 30 which extends from the distal portion 25 and to a support portion 29. The support portion 29 has a third diameter which is larger than the second diameter of the distal portion 25. The nose cone 24 has an outer diameter larger than the remaining outer diameters of the spindle 22.

The spindle 22 is connected to, or is axially displaceable together with, the actuator mandrel 12 relative to the actuator housing 14.

Figure 2:
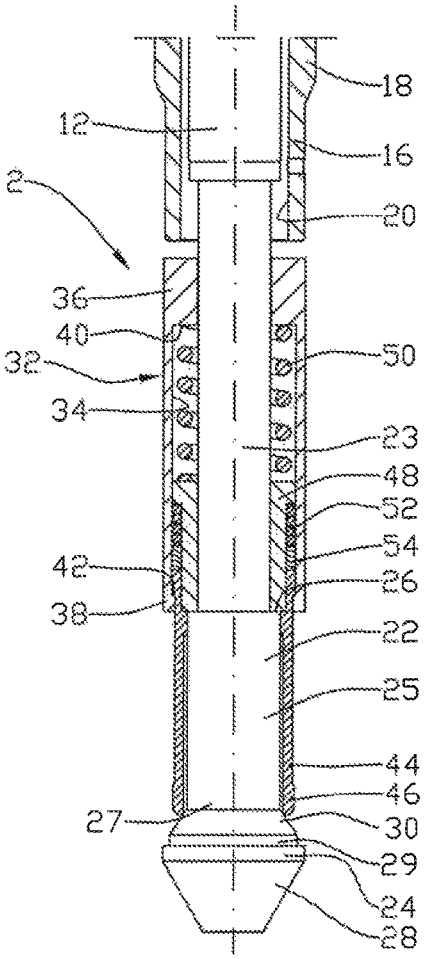
FIG. 2 shows in a larger scale a cross-section I-I in FIG. 1.

A tool housing 32 encloses the axially displaceable spindle 22. The middle portion 34 of the tool housing 32 has a larger inner diameter than a first end portion 36 of the tool housing 32 which faces the actuator 4 and a second end portion 38 which is opposite to the first end portion 36. The different inner diameters of the tool housing 32 form a spring abutting surface 40 close to the first end portion 36 and a gripper abutting surface 42 close to the second end portion 38, see FIG. 2.

A number of longitudinal grippers 44 are distributed around the spindle 22. At its free end portion each gripper 44 is provided with a gripping bulb 46. At their opposite end portion the grippers 44 protrudes in between the spindle 22 and the tool housing 32 where they bear against the gripper abutting surface 42.

A spring sleeve 48 encircles the spindle 22 and is by means of a relatively strong main spring 50 which bears against the spring abutting surface 40, tensioned axially towards the spindle shoulder 26.

An auxiliary spring 52 is clamped between the spring sleeve 48 and a support ring 54. Both the auxiliary spring 52 and the support ring 54 encircle the spring sleeve 48. The support ring 54 abuts against the grippers 44. The auxiliary spring 52 thereby tensions the grippers 44 axially towards the gripper abutting surface 42. The auxiliary spring 52 is substantially weaker than the main spring 50.

Figure 4:
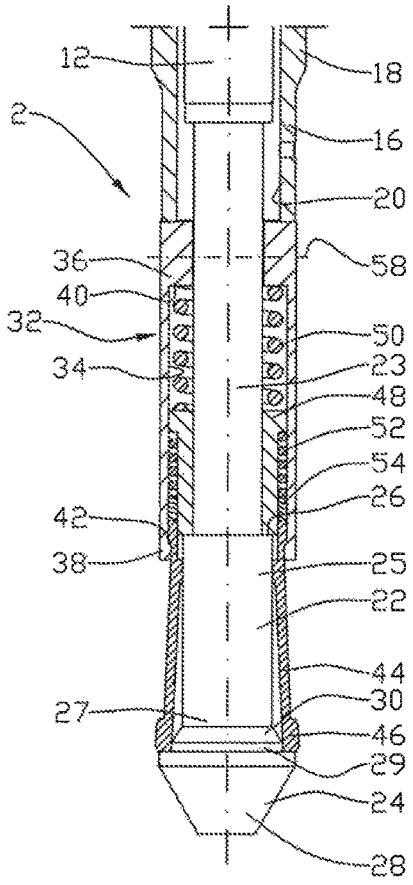
FIG. 4 shows in a larger scale a cross-section III-III in FIG. 3.

When the grippers 44 are being activated in order to grip an object 56, see FIGS. 3 and 4, the actuator mandrel 12 is displaced inwardly in the actuator housing 14. The spindle 22 is thereby displaced in a direction towards the actuator 4, whereby the tool housing 32 is brought to impact with the activating sleeve 16. Further displacement of the actuator mandrel 12 causes the spindle 22 to be pulled inwards in the tool housing 32 while the main spring 50 is tensioned. The auxiliary spring 52 is correspondingly extended. The grippers 44 are thereby displaced along the activating cone 30 and reach their activated position wherein the gripping bulbs 46 are in engagement with the object 56 and wherein the grippers 44 are supported by the support portion 29.

When the grippers 44 are about to be deactivated in order to release the object 56, the actuator mandrel 12 is displaced outwards in the actuator housing 14. The spindle 22 is thereby displaced in a direction from the actuator 4 and inwards in the object 56. The main spring 50 displaces the tool housing 32 and the grippers 44 relative to the spindle 22 such that the grippers 44 are displaced down along the activating cone 30 from the support portion 29. The main spring 50 is released while the auxiliary spring 52 is correspondingly tensioned. Further displacement of the actuator mandrel 12 displaces the tool housing 32 from the activating sleeve 16, see FIGS. 1 and 2.

A centre line 58 in FIG. 4 shows the position of a not shown shear bolt according to prior art. This shear bolt is not used in accordance with the invention.

It is pointed out that all the above-mentioned embodiments illustrate the invention but do not limit it, and skilled persons in the art will be able to form many alternative embodiments without deviating from the scope of the accompanying claims. In the claims, the reference numerals in parenthesis are not to be considered as limiting. The use of the verb "to comprise" and its different forms does not exclude the presence of elements or steps which are not mentioned in the claims. The indefinite article "a" or "an" in front of an element does not exclude the presence of more such elements.

The fact that some features are referred to in mutually different dependent claims, does not indicate that a combination of these features may not advantageously be used.

The invention claimed is:

1. Method for activating and deactivating a GS-tool (2) wherein the GS-tool (2) in addition to grippers (44), a tool housing (32) and an axially displaceable spindle (22) comprises a main spring (50) arranged to pre-tension the grippers (44) towards a deactivated position, as the GS-tool (2) is displaceable in a wellbore (10) in the ground, the method comprises the following steps:

coupling the axially displaceable spindle (22) of the GS-tool (2) to an axially displaceable actuator mandrel (12) of an actuator (4);

arranging an activating sleeve (16) connected to an actuator housing (14) between the tool housing (32) and the actuator housing (14), said tool housing (32) being axially displaceable relative to the activating sleeve (16);

activating the GS-tool by displacing axially the actuator mandrel (12) and thereby the spindle (22) relative to the tool housing (32) in a first axial direction whereby the tool housing (32) is brought to impact with the activation sleeve (16), and displacing the actuator mandrel (12) further until the grippers (44) reached the activated positions by overcoming a force from the main spring (50); and deactivating the GS-tool by displacing axially the actuator mandrel (12) and thereby the spindle (22) relative to the tool housing (32) in a second axial direction opposite the first axial direction whereby the main spring (5) displaces the tool housing (32) and the grippers (44) relative to the spindle (22) such that the grippers (44) are displaced down along an activating cone (30).

2. Method in accordance with claim 1, wherein the method comprises the further step of maintaining the grippers (44) in activated or deactivated position during the displacement of the GS-tool (2) into or out of the wellbore (10).

3. Method in accordance with claim 1, wherein the method comprises the step of bringing an object (56) into the wellbore (10), and released the object (56) from the GS-tool (2) by displacing the actuator mandrel (12) without blows, axially outwardly relative to the actuator housing (14).

4. Method in accordance with claim 1, wherein the method comprises bringing an object (56) out of the wellbore (10) as the object (56) is coupled to the GS-tool (2) by displacing the actuator mandrel (12) without blows, axially inwards relative to the actuator housing (14).

5. A GS-tool (2) displaceable in a wellbore (10) in a ground, the GS-tool (2) comprises:

grippers (44);

a tool housing (32) and an axially displaceable spindle (22); and further comprises a main spring (50) arranged to pre-tension the grippers (44) in a direction towards a deactivated position;

axially displaceable the spindle (22) is coupled to an actuator mandrel (12) of an actuator (4), and an activating sleeve (16) connected to an actuator housing (14) is arranged between the tool housing (32) and the actuator housing (14), said tool housing (32) being axially displaceable relative to the activating sleeve (16), and the main spring (50) is tensioned and the grippers (44) are in activated positions when the displaceable spindle (22) is displaced in a first axial direction in the tool housing (32) towards the actuator (4), and said spindle (22) and mandrel (12) being axially displaceable relative to the actuator housing (14) and the activating sleeve (16).

6. GS-tool (2) in accordance with claim 5, wherein the activating sleeve (16) is fastened to the actuator housing (14).

7. GS-tool (2) in accordance with claim 5, wherein on an outside of the activating sleeve (16) guiding ribs (18) are provided encircling the activating sleeve (16).

8. GS-tool (2) in accordance with claim 5, wherein the grippers (44) are displaceable on an activating cone (30) between their activated and deactivated positions, as the activating cone (30) is connected to or constitutes part of the spindle (22).

9. GS-tool (2) in accordance with claim 5, wherein an assembly (1) of the GS-tool (2) and the actuator (4) is coupled to an automotive propulsion device (6).

10. GS-tool (2) in accordance with claim 5, wherein an assembly (1) of the GS-tool (2) and the actuator (4) is coupled to a connection (8) in the form of a string, coiled tubing or a cable.

* * * * *